US010315801B2

(12) United States Patent
Molander

(10) Patent No.: US 10,315,801 B2
(45) Date of Patent: Jun. 11, 2019

(54) COLLAPSIBLE BOX

(71) Applicant: Frametray Tech AB, Dalby (SE)

(72) Inventor: Henrik Molander, Limhamn (SE)

(73) Assignee: Frametray Tech AB, Dalby (SE)

( * ) Notice: Subject to any disclaimer, the term of this patent is extended or adjusted under 35 U.S.C. 154(b) by 96 days.

(21) Appl. No.: 15/581,094

(22) Filed: Apr. 28, 2017

(65) Prior Publication Data

US 2017/0320627 A1 Nov. 9, 2017

(30) Foreign Application Priority Data

May 3, 2016 (EP) ..... 16168146

(51) Int. Cl.

| | |
|---|---|
| ***B65D 21/06*** | (2006.01) |
| ***B65D 1/22*** | (2006.01) |
| ***B65D 21/08*** | (2006.01) |
| ***B65D 21/02*** | (2006.01) |

(52) U.S. Cl.

CPC ..... *B65D 21/068* (2013.01); *B65D 1/225* (2013.01); *B65D 21/0213* (2013.01); *B65D 21/086* (2013.01)

(58) Field of Classification Search

CPC .. B65D 21/068; B65D 21/225; B65D 21/086; B65D 1/225

See application file for complete search history.

(56) References Cited

U.S. PATENT DOCUMENTS 5,671,857 A 9/1997 Stromberg
6,155,444 A * 12/2000 Liu ..... B65D 1/225 220/7
6,416,701 B1 7/2002 Molander

FOREIGN PATENT DOCUMENTS

| | | |
|---|---|---|
| DE | 2506427 A1 | 9/1975 |
| FR | 2321431 | 3/1977 |
| WO | 2006011093 A1 | 2/2006 |
| WO | 2013002725 A1 | 1/2013 |
| WO | 2013142078 A1 | 9/2013 |

* cited by examiner

*Primary Examiner* — Andrew T Kirsch

*Assistant Examiner* — Don M Anderson

(74) *Attorney, Agent, or Firm* — Capitol City TechLaw

(57) ABSTRACT

A collapsible box has a bottom with a plurality of foldable walls, each of which is hinged to the bottom. Each wall is displaceable between a collapsed state and an erected state, in which the walls are connected by locking means. The bottom and the walls in the erected state define a space. The bottom includes a guiding element configured to receive at least a part of an upper rim of another collapsible box stacked underneath.

14 Claims, 8 Drawing Sheets

COLLAPSIBLE BOX

PRIORITY STATEMENT

This US non-provisional application claims priority under 35 USC § 119 to European Patent Application No. 16168146.5, which was filed on May 3, 2016, the entire content of which is incorporated herein by reference.

BACKGROUND

1. Technical Field

The present invention relates to a collapsible container and more specifically to a collapsible box.

2. Description of Related Art

In the global society we live in today we are used to always getting almost every product no matter which country the product comes from all year around. This means a lot of transportation. Packaging, storing and transportation have become a huge industry which has to constantly develop in order to keep up with the changing supplies of products, quantities and storage demands. For transportation, trucks are often used and this might not be the best option from an environmental point of view. Thus, transportation with trucks has to be optimized for environmental reasons.

Also, in order to reduce lead time and lower costs the transportation and storage process demand easy and efficient packaging. An example is a classic loading pallet, which might be easy to pack in but which is not advantageous when it is empty.

The publications WO 2013/002725 and WO 2006/011093 are two examples of prior art which have developed the area of packaging but both of these known boxes have disadvantages. The first one is a rather simple box with several parts that after some time in use can start to cause problems, especially around the hinge connection between the bottom edge of the side wall and the edge of the base member. The hinge connection is also disadvantageous from a manufacturing and assembling perspective. Further, the known plastic box lacks of strength and stability when stacking many boxes on top of each other.

The second known box is a more complex construction with many small details, which makes the manufacturing process even more difficult. Another disadvantage with this box is that a part of it covers the space within the box which makes it difficult to pack goods into it, and even more difficult if the packing process is made by a robot. Yet another disadvantage is that the heads of the container may be difficult to find when trying to stack a second container on top of the first.

Thus there is room for improvements in proposing a container or box that is suitable for all types of goods and demands both in a situation when transporting goods and in a situation when it is empty.

SUMMARY

An object of the present invention is to provide an improved collapsible box. This object is achieved by a technique defined in the appended independent claims; certain embodiments being set forth in the related dependent claims.

In a first aspect, there is provided a collapsible box having a bottom with a plurality of side edges, a plurality of foldable walls each of which is hinged to one side edge of the bottom respectively. Each wall is foldable between a collapsed state and an erected state, in which the walls are connected by locking means. The bottom together with the walls in the erected state define a space. Further, the bottom comprises a guiding element configured to receive at least a part of an upper rim of another collapsible box stacked underneath. This improved box with its guiding element makes it very easy to stack and it is well suited for both manual work and automated processes.

In an embodiment, guiding element is a groove arranged along said side edges of an outer surface of said bottom. A groove is easy to find when it is hard to see every part of the boxes when stacking them together. The bottom with the groove of the box on top of another is easy to guide into the right position and the worker stacking the boxes does not have to care to make sure that every part of the boxes is in their right position when stacked. It is also easy to manufacture a groove and not run the risk of being damaged during the handling process and storage.

In another embodiment, the groove is configured to receive the upper rim of another collapsible box stacked underneath. It is advantageous to receive the entire upper rim of the other box to increase the stability and strength of the pile of boxes.

In yet another embodiment, the box substrate is made in one piece. This is advantageous from a manufacturing, an assembling and a handling point of view. With no additional parts there is no risk of losing any during handling, transportation or storing processes. Also it makes the assembling process easier which can be managed by one person or be completely automated.

In an embodiment, the box is stackable in said collapsed state in which the box substrate is substantially planar. This reduces the volume needed when transporting empty boxes, thus increasing the number of boxes that can be transported in for example one truck.

In another embodiment, each wall forms in said erected state an angle of less than 90° to said bottom. This gives the box even more stacking advantages.

In yet another embodiment, the box comprises a first wall of said walls and a second wall of said walls where the second wall is configured to be connected to and partly overlap the first wall in the erected state.

Preferably, the at least one part of a top edge of the second wall at least partly overlapping the first wall slightly protrudes above the first wall in a direction away from the bottom. This is beneficial since the load of the boxes stacked on top of the box is taken and controlled by the top edge and the part of the second wall over lapping the first wall. The load can then be controlled to preferred parts of the box and not affect weaker spots.

In another embodiment, the second wall comprises a first and a second foldable extended wall portion and an intermediate wall portion, wherein the first and the second extended wall portions are hinged to a first and a second edge of said intermediate wall portion respectively. Further, in an embodiment the first and second extended wall portion are arranged to at least partly engage an inner surface of said first wall respectively, in said erected state. The extended wall portions are easy to fold and attach when assembling the box and can easily be made by one person or be completely automated.

In yet another embodiment, the first and second extended wall portion comprises at least one reinforcement element and said first wall comprises at least one reinforcement element, which is shaped to fit and arranged within the reinforcement element of the first and second extended wall portion respectively, in said erected state. The reinforcement elements of both walls together increase the strength and stability of the box, especially when boxes with load are stacked on top.

Further, in an embodiment, the at least one reinforcement element of said extended wall portions and said at least one reinforcement element of said first wall is shaped as a wedge. This shape even more increases the strength and stability of the box. It is also advantageous when manufacturing the box substrate and when stacking the box substrate in the collapsed state.

In yet another embodiment, at least a part of a top edge of the first and second extended wall portion slightly protrude above said first wall in a direction away from the bottom, in said erected state. This is advantageous since the load of the boxes stacked on top of the box is taken and controlled by the top edge and the part of the second wall over lapping the first wall. The load can then be controlled to preferred parts of the box and not affect weaker spots.

Preferably, the first and second extended wall portion comprise at least one protruding part which is arranged to engage at least one recess of said bottom in the erected state. This is favorable since the extended wall portions are guided into the right position when assembling the box and the extended wall portions are every time placed in the same position no matter if a person or a robot does the job. The protruding parts and recesses also make it possible for the extended wall portions to stay in the same place during use.

In yet another embodiment, the first and second extended wall portion are connected to said first wall respectively by means of said fastening means, wherein said fastening means is a snap-lock arrangement. The snap-lock arrangement is an easy locking arrangement and can be managed by both a person and a robot.

Further, in an embodiment each wall further comprises a reinforcement element having a base part arranged in a direction away from said bottom. The base may act as an extra support when stacking boxes on top of each other as a box may rest thereon.

BRIEF DESCRIPTION OF THE DRAWINGS

Embodiments of the invention will be described in the following, reference being made to the appended drawings which illustrate non-limiting examples of how the inventive concept can be reduced into practice.

DESCRIPTION OF NON-LIMITING EMBODIMENTS

Figure 1:
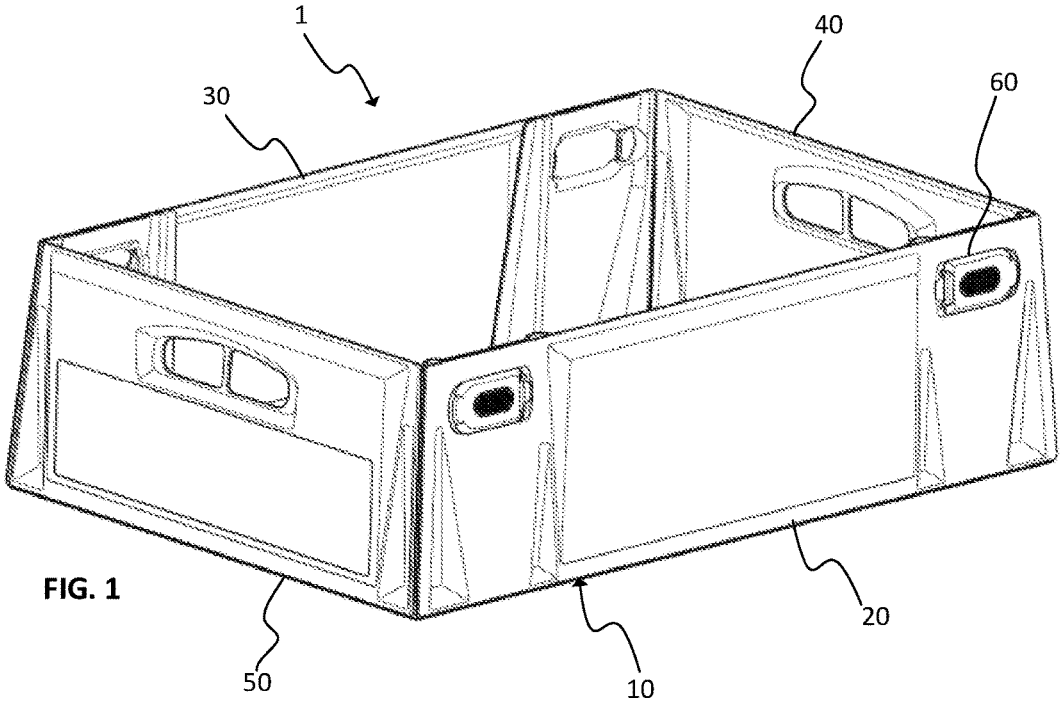
FIG. 1 is a perspective view of a collapsible box according to an embodiment shown in its erected state.
Figure 2:
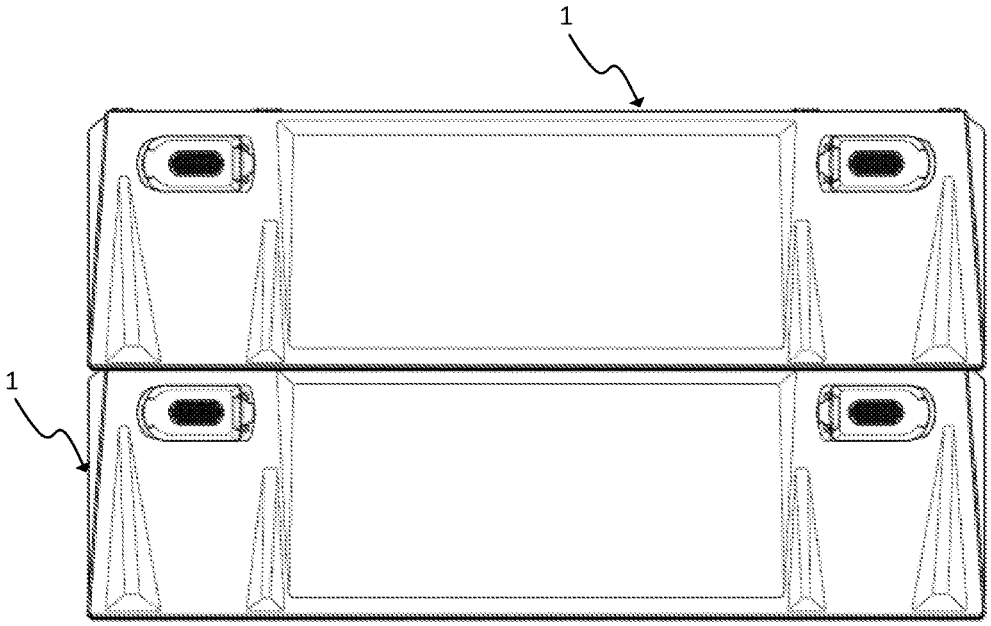
FIG. 2 is a front view of two collapsible boxes, shown in FIG. 1, stacked on top of each other.
Figure 3:
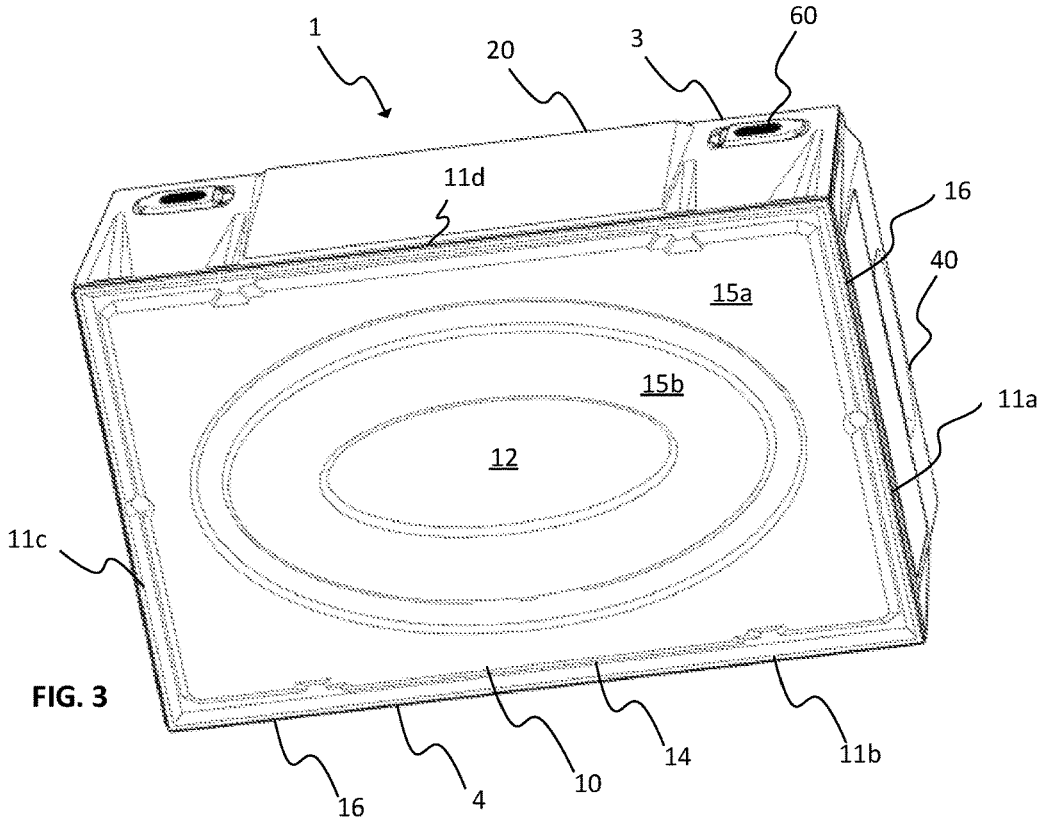
FIG. 3 is a bottom view of the box in FIG. 1.
Figure 4:
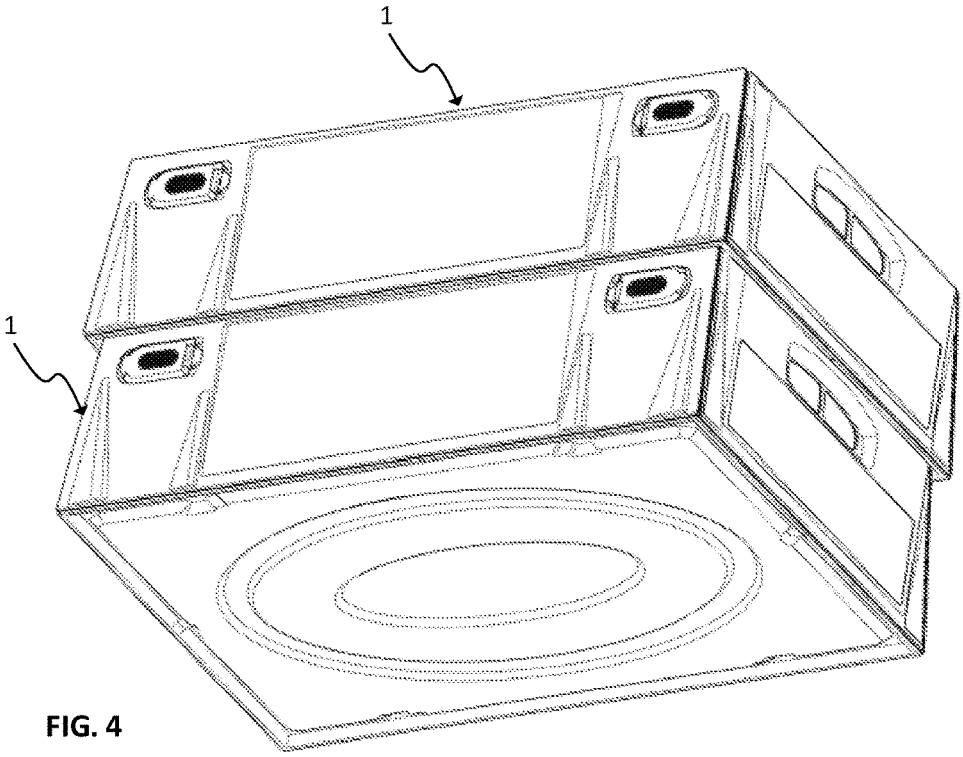
FIG. 4 is a bottom view of the two boxes of FIG. 2 stacked on top of each other.
Figure 5:
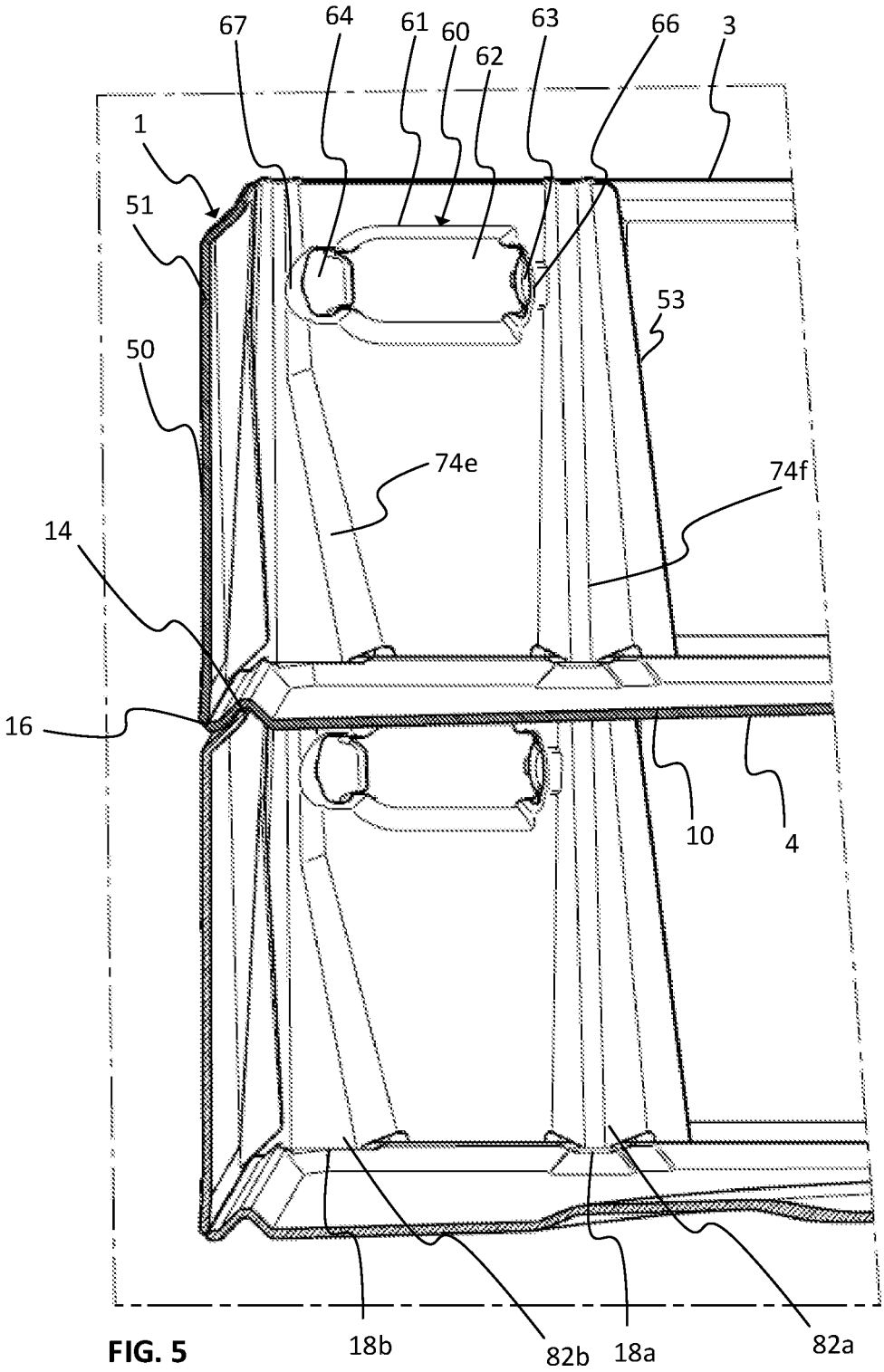
FIG. 5 is a cross sectional view showing the inside of a section of the two stacked boxes in FIG. 2.
Figure 6:
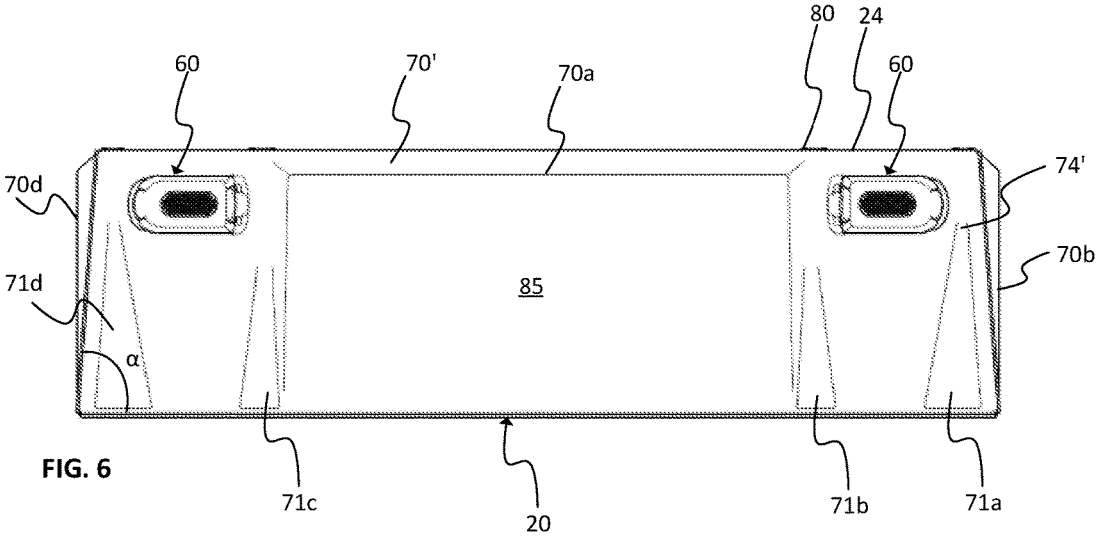
FIG. 6 is a front view of the box in FIG. 1.
Figure 7:
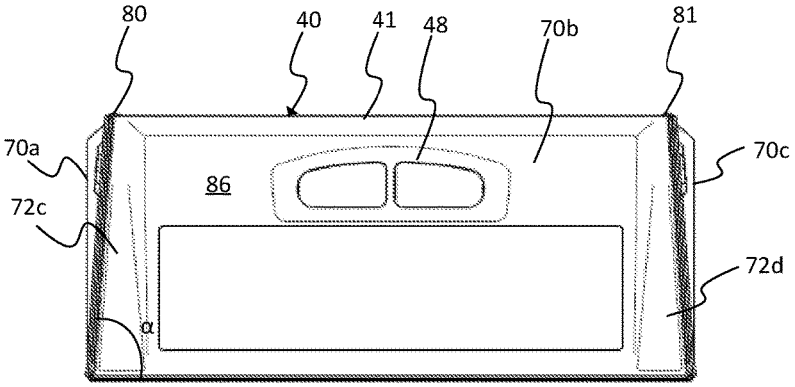
FIG. 7 is a side view of the box in FIG. 1.
Figure 8:
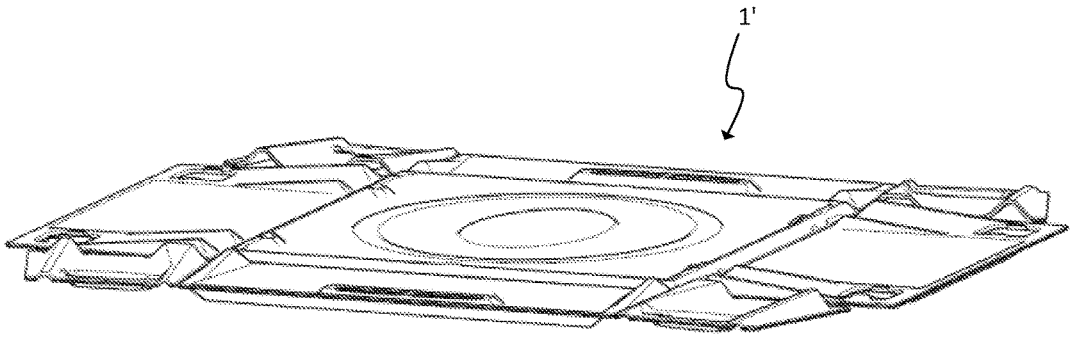
FIG. 8 is a perspective view of the box in FIG. 1 shown in its collapsed state.
Figure 9:
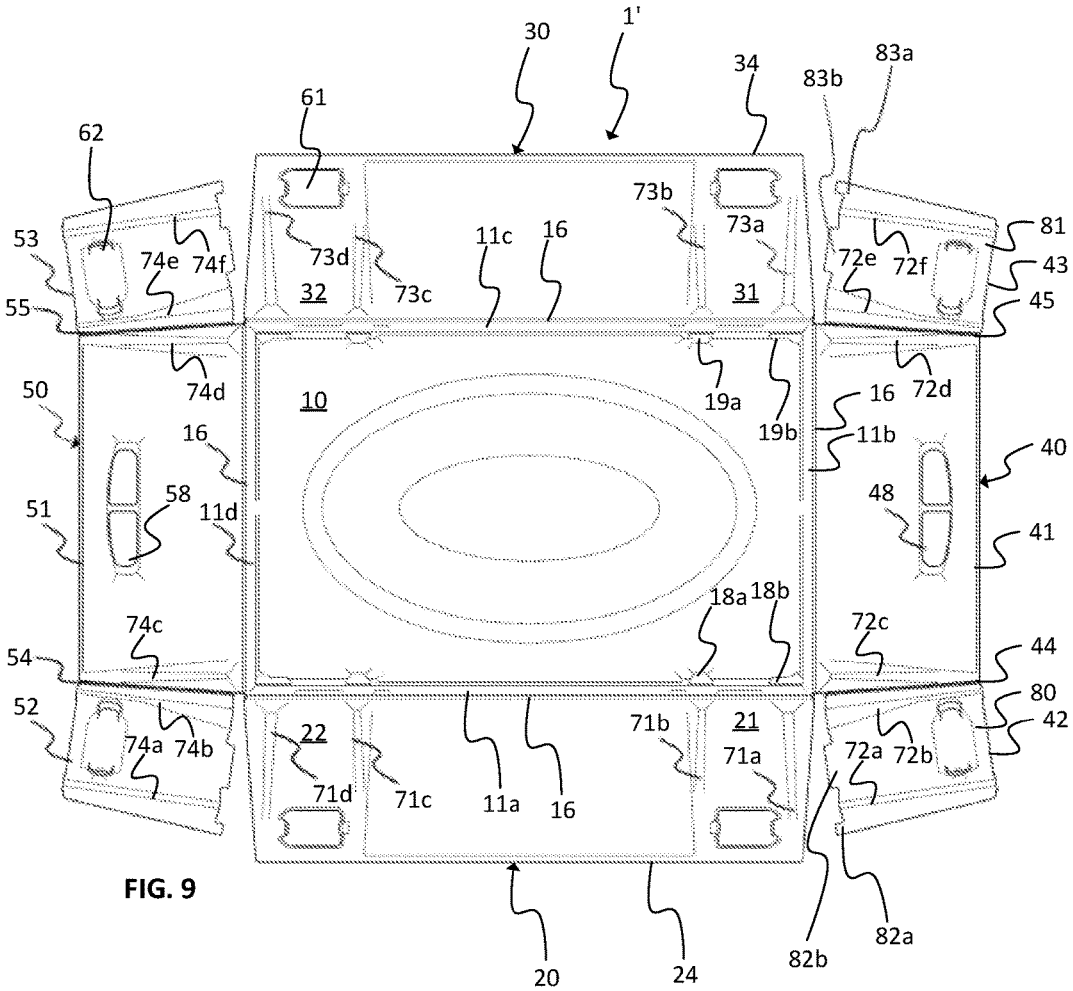
FIG. 9 is a top view of the box in FIG. 7.
Figure 10:
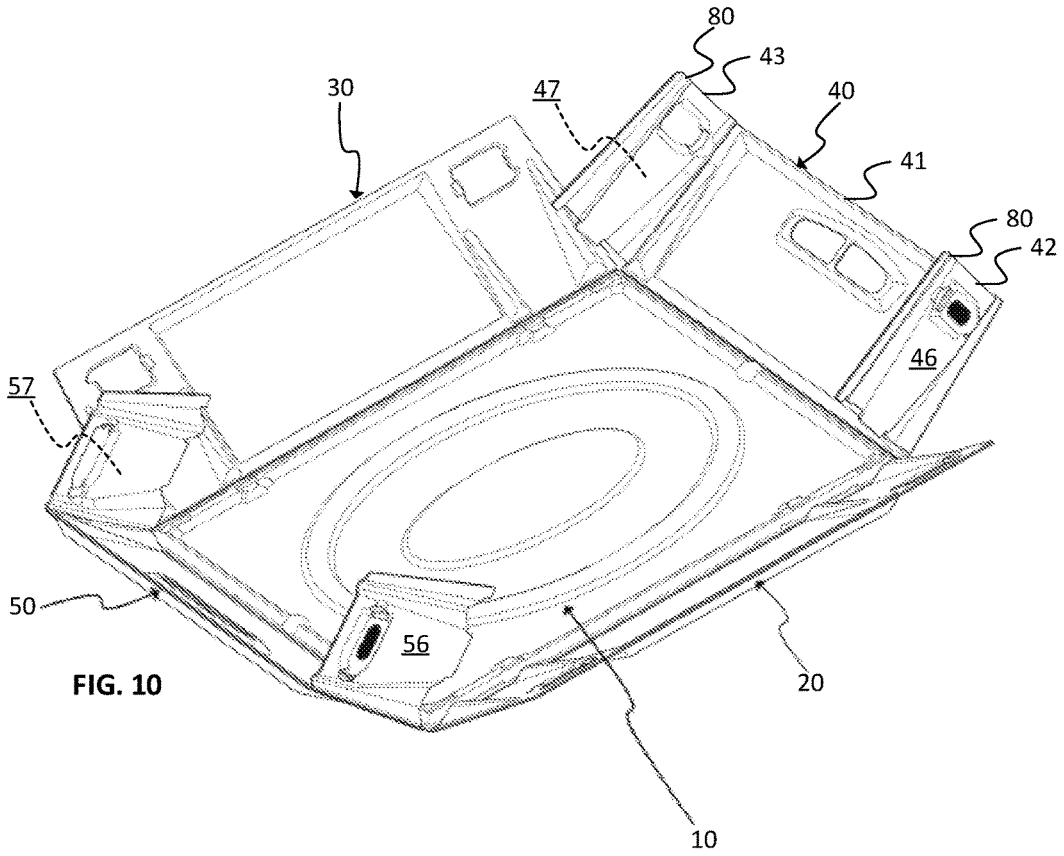
FIG. 10 is a perspective view of the box in FIG. 1 in a folding state.
Figure 11:
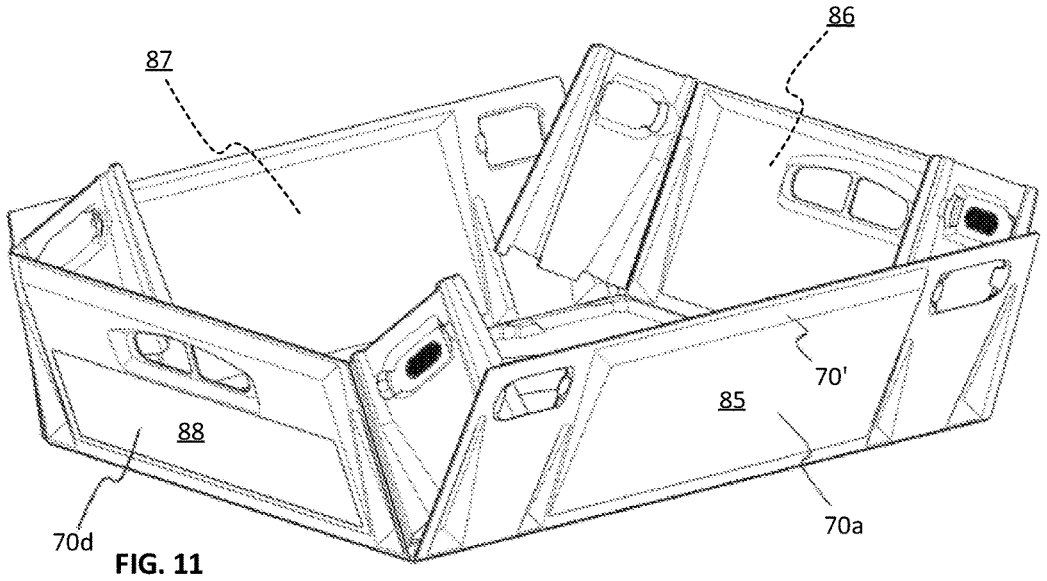
FIG. 11 is a perspective view of the box in FIG. 1 in a folding state.
Figure 12:
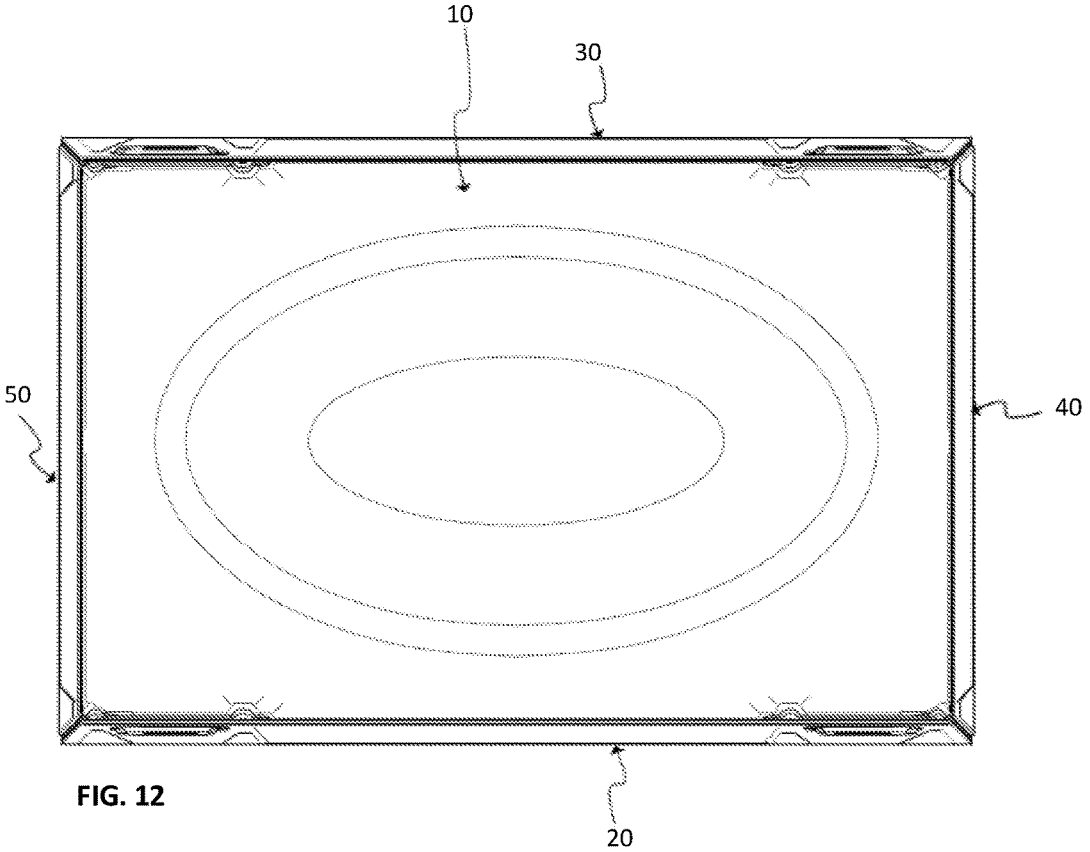
FIG. 12 is a top view of the box in FIG. 1.

With reference to the figures a collapsible container or collapsible box 1 is shown, from now on just called the box 1. The box 1 is preferably made of a plastic material and designed such that it is possible for it to assume different states, e.g. a collapsed state and an erected state. For example FIGS. 1-7 show the box 1 in its erected state and FIGS. 8 and 9 show the box substrate 1' in the collapsed state, where the box substrate 1' is planar. The box substrate 1' is manufactured in one piece and is in no need of any additional elements when assembled into the box 1. Its erected state is preferred when handling, storing and transporting goods and its collapsed state is preferred for storage and transportation of empty boxes.

The box 1 has a bottom 10 with a plurality of side edges 11*a*, 11*b*, 11*c*, 11*d*. In the described embodiment two of the side edges 11*a*, 11*c* are shorter than the other two 11*b*, 11*d*. Along the side edges 11*a*, 11*b*, 11*c*, 11*d*, on the outer surface 12 of the bottom 10 there is a guiding element 14 provided. The guiding element is in this case a groove 14 arranged to act as a guide when stacking one box in the erected state on top of another. The groove 14 is shaped to match the top rim 3 of another collapsible box, stacked under the first box and the groove 14 helps to increase the stability of a pile when several boxes are packed on top of each other. The bottom 10 further has reinforcement sections 15*a*, 15*b* which are arranged to increase the strength and stability of the box 1.

Furthermore, the box 1 has a first set of foldable walls 20, 30 and a second set of foldable walls 40, 50, wherein each wall 20, 30, 40, 50 is at least partly hinged to one side edge 11*a*, 11*b*, 11*c*, 11*d* of the bottom 10 respectively. Each wall 20, 30 of the first set are preferably identical and will from now on be called the long-side walls 20, 30. Thus, features of the long-side wall defined in the description will apply to both walls 20, 30. The same goes for the walls 40, 50 of the second set. These are also identical and will from now one be called the short-side walls 40, 50.

The long-side walls 20, 30 are preferably hinged to respective longer side edge 11*b*, 11*d* of the bottom 10 by means of a hinge arrangement 16. The short-side walls 40, 50 are preferably at least partly hinged to respective shorter side edge 11*a*, 11*c* by means of the hinge arrangement 16. The hinge arrangement 16 connects one wall 20, 30, 40, 50 to one side edge 11*a*, 11*b*, 11*c*, 11*d* of the bottom and allows the walls 20, 30, 40, 50 to be folded between the collapsed state and the erected state. Furthermore, the hinge arrangement 16 is an integrated hinge arrangement formed by an area with less material than the adjacent walls 20, 30, 40, 50 and bottom 10.

The short-side wall 40, 50 has an intermediate wall portion 41, 51 and two extended wall portions 42, 43, 52, 53. The first extended wall portion 42, 52 is hinged to a first edge 44, 54 of the intermediate wall portion 41, 51 and the second extended wall portion 43, 53 is hinged to a second edge 45, 55 of the intermediate wall portion 41, 51. The hinge arrangement between the extended wall portions 42, 43, 52, 53 and the intermediate wall portion 41, 51 is of the same kind as the above described hinge arrangement 16, i.e. an integrated arrangement formed by an area with less material that the adjacent portions 41, 42, 43, 51, 52, 53.

Both extended wall portions 42, 43, 52, 53 are foldable. The intermediate wall portion 41, 51 of the short-side wall 40, 50 is connected to the side edge 11*b*, 11*d* of the bottom 10 by means of the hinge arrangement 16.

The first and second extended wall portions 42, 43, 52, 53 are arranged to at least partly engage the respective long-side wall 20, 30 in the erected state. For example FIGS. 9-13 show the box 1 on its way to and in the erected state where an outside surface 46, 47, 56, 57 of the first and second extended wall portions 42, 43, 52, 53 engages a part of an inside surface 21, 22, 31, 32 of respective long-side wall 20, 30.

The extended wall portion 42, 43, 52, 53 and the long-side wall 20, 30 are locked together by locking means, in this case a snap-lock arrangement 60. There are four such locking arrangements 60 on the box holding its walls 20, 30, 40, 50 in their intended position of the erected state. Other locking arrangements are of course possible to use. Each snap-lock arrangement 60 is formed by a cavity 61 arranged on the long-side wall 20, 30 and a protruding locking element 62 arranged on the outside surface 46, 47, 56, 57 of the extended wall portion 42, 43, 52, 53. The protruding locking element 62 has a first engaging part 63 and a second engaging part 64 which are arranged on opposite sides of the locking element 62. The first engaging part 63 is formed to engage a first edge portion 66 of the cavity 61 which together prevent the walls 20, 30, 40, 50 of the box 1 to collapse. The second engaging part 64 is formed to engage a second edge portion 67 of the cavity 61 and to snap into a locked state.

When assembling the box 1, i.e. changing from the collapsed state to the erected state, the extended wall portions 42, 43, 52, 53 are folded in towards the intermediate wall portion 41, 51, the walls 20, 30, 40, 50 raised towards each other and then locked in position by means of the snap-lock arrangement 60. When disassembling the box 1, i.e. changing from the erected state to the collapsed state, the protruding locking element 62 is released from the cavity 61 and the walls 20, 30, 40, 50 lowered. This assembling and disassembling process may well be automated by e.g. robots.

Each short-side wall 40, 50 also have a handle 48, 58 for making the handling of the box in the erected state easier.

In order to increase the strength, robustness and stability of the box 1 each wall 20, 30, 40, 50 is provided with at least one reinforcement element 70*a-d* of a first type and a number of reinforcement elements 71*a-d*, 72*a-f*, 73*a-d*, 74*a-f* of a second type. One reinforcement element 70*a-d* of the first type is in this embodiment located in the center of each wall 20, 30, 40, 50. It is basically wedge-shaped with its base 70' pointing upwards, away from the bottom 10 in the erected state. The base 70' may act as an extra support when stacking boxes 1 on top of each other, as the bottom rim 4 may rest thereon. Furthermore, the reinforcement element 70*a-d* also increases the flexural rigidity of each wall 20, 30, 40, 50.

The second type of reinforcement elements 71*a-d*, 72*a-f*, 73*a-d*, 74*a-f* also has a wedge-like or conical shape which from one side of the wall protrudes and from the opposite side of the wall is immersed. In the erected state the protrusion of the second type of reinforcement elements 71*a-d*, 72*a-f*, 73*a-d*, 74*a-f* is in the direction towards the inside of the box 1. The tip 74' of the reinforcement element 71*a-d*, 72*a-f*, 73*a-d*, 74*a-f* of the second type is pointing upwards, away from the bottom 10, in the erected state. In the described embodiment each long-side wall 20, 30 has four reinforcement elements 71*a-d*, 73*a-d* of the second type of optionally varying size and each short-side wall 40, 50 has six reinforcement elements 72*a-f*, 74*a-f* of the second type of optionally varying sizes. The shape, size and number of all the reinforcement element 70*a-d*, 71*a-d*, 72*a-f*, 73*a-d*, 74*a-f* may vary. Each reinforcement element 70*a-d*, 71*a-d*, 72*a-f*, 73*a-d*, 74*a-f* acts as an extra support member for each wall 20, 30, 40, 50 and allows the walls 20, 30, 40, 50 of the box 1 to incline inwards, without decreasing the ability to carry loads. The inclination of the walls will later be described in more detail.

The intermediate wall portion 41, 51 of the short-side wall 40, 50 has two reinforcement elements 72*c-d*, 74*c-d* of the second type, one on each side of the protruding section 71, 73. Further, each extended wall portion 42, 43, 52, 53 has two reinforcement elements 72*a-b*, 72*e-f*, 74*a-b*, 74*e-f* of the second type, one on each side of the locking element 62 of the snap-lock arrangement 60. The long-side wall 20, 30 has four reinforcement elements 71*a-d*, 73*a-d* of the second type, two on each side of the protruding section 70, 72, one on each side of the cavity 61 of the snap-lock arrangement 60. The four reinforcement elements 71*a-d*, 73*a-d* of the second type of the long-side wall 20, 30 are formed to each match the shape of one of the reinforcement element 72*a-b*, 72*e-f*, 74*a-b*, 74*e-f* of the second type of the extended wall portions 42, 43, 52, 53 of the short-side wall 40, 50. They are, in the erected state, arranged such that they engage each other, i.e. the protruding part of one reinforcement element 71*a-d*, 73*a-d* matches and engages the immersed part of another reinforcement element 72*a-b*, 72*e-f*, 74*a-b*, 74*e-f* such that they are in close contact with each other.

Figure 13:
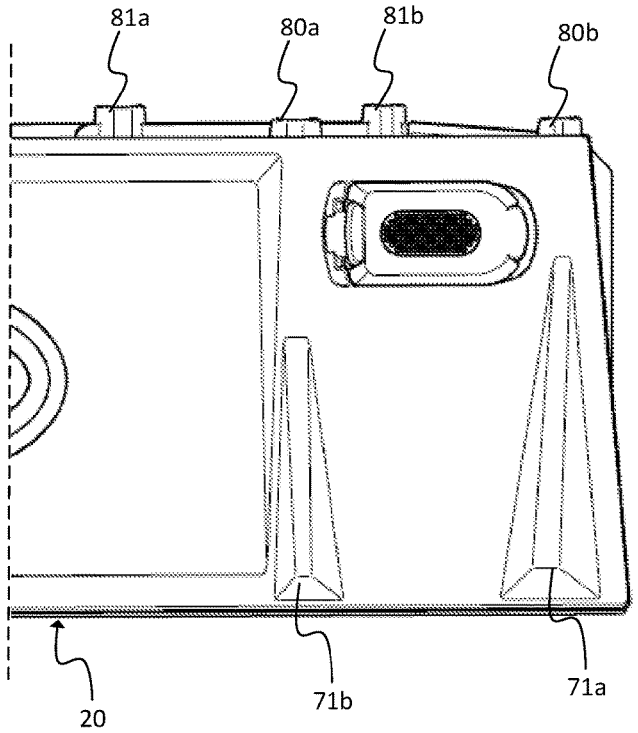
FIG. 13 is a detailed view of a section of one side of the box in FIG. 1.
Figure 14:
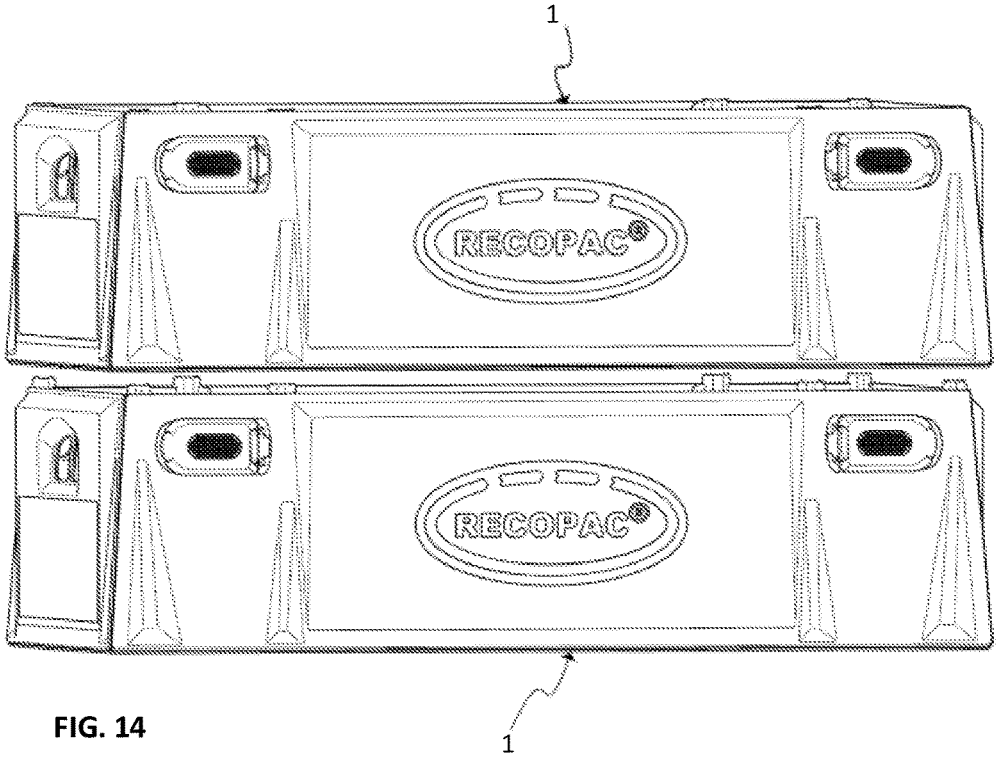
FIG. 14 is a perspective view of two boxes before stacked on top of each other.

In the erected state, at least a part of a top edge 80*a-b*, 81*a-b* of the extended wall portion 42, 43, 52, 53 slightly protrudes above a top rim 24, 34 of the long-side wall 20, 30 in a direction away from the bottom 10. The protruding top edge is illustrated in e.g. FIG. 13, slightly exaggerated but so that the design come across. The top edge 80*a-b*, 81*a-b* can have various shapes and sizes. For example FIG. 13 shows a protruding portion, which there is eight of in the illustrated embodiment, but it can also be a continuous rim, straight or curved. Also the thickness of the top edge 80*a-b*, 81*a-b* can vary and the height of which it protrudes above the top rim 24, 34 of the wall 20, 30. Preferably, the height may vary between 0.5 and 3 mm. This feature may provide advantages, as described below.

The extended wall portion 42, 43, 52, 53 further has at least one protruding part, in this case two parts 82*a*, 82*b*, 83*a*, 83*b*, which in the erected state is arranged in a recess 18*a*, 18*b*, 19*a*, 19*b* of the bottom 10. Each recess 18*a*, 18*b*, 19*a*, 19*b* acts as a guide when assembling the box 1, so that the walls and their components of the box always are in their right places in the erected state. It also serves as a support for the extended wall portion 42, 43, 52, 53 when loading the box and stacking boxes on each other. Due to the protruding top edge 80*a-b*, 81*a-b* of the extended wall portion 42, 43, 52, 53 and the protruding parts 82*a*, 82*b*, 83*a*, 83*b* most of the weight and load of the box or boxes, when stacking one box on top of another, will be distributed into the extended wall portion 42, 43, 52, 53 and into the bottom 10. The weight and load will not affect the hinge arrangement 16 between the long-side walls 20, 30 and the bottom 10 and this will create a stronger and more stable arrangement of boxes. The protruding top edge 80*a-b*, 81*a-b* does not depend on the protruding parts 82*a*, 82*b*, 83*a*, 83*b* and recesses 18*a*, 18*b*, 19*a*, 19*b* described above. When the box 1 is in its erected state the main walls 20, 30, 40, 50 has an inclination with respect to the bottom 10. The angle $\alpha$ between the bottom 10 and the walls 20, 30, 40, 50 is less than 90°. Preferably, the angle α is between 80 and 89.5°. The reinforcement element 70*a-d* of the first type partly forms outside surfaces 85, 86, 87, 88 of the walls 20, 30, 40, 50, which does not have the same inclination. The outside surfaces 85, 86, 87, 88 are instead substantially perpendicular to the bottom 10. This means that sections of each wall 20, 30, 40, 50 has a triangular-shaped cross section with its base 70' arranged in a direction away from the bottom 10. This gives the box 1 stacking and stability advantages.

In an alternative embodiment (not shown) each wall, in the erected state, is substantially perpendicular to the bottom, i.e. the angle is substantially 90°, from the bottom up to an upper part of the wall. The upper part then preferably inclines in towards to other walls in order to achieve the same stacking possibilities as the above described embodiment.

The box substrate is made in one piece and every part of is designed so that the box is stackable on top of each other either if it is in the erected state or the collapsed state. This is very beneficial in order to reduce empty or unnecessary transports. As it is made in one piece and no additional parts are necessary it is very easy to assemble the box substrate to a "ready to use" box. Both the assembling and disassembling process can advantageously be automated, so also the manufacturing process.

The plastic material used in the described embodiment is polypropylene. Other materials may be used depending on its application, for example other plastic materials, carbon fiber materials or similar.

Finally, although the inventive concept has been described above with reference to specific embodiments, it is not intended to be limited to the specific form set forth herein. Rather, the invention is limited only by the accompanying claims and other embodiments that the specific above are equally possible within the scope of these appended claims.

What is claimed is:

1. A collapsible box comprising:

a bottom with a plurality of side edges;

a plurality of foldable walls, each of which is hinged to one of the side edges of the bottom, respectively;

wherein each of the walls is foldable between a collapsed state and an erected state, in which the walls are connected by a lock mechanism;

wherein the bottom and the walls in the erected state define a space;

wherein the bottom includes a guiding element configured to receive at least a part of an upper rim of another collapsible box stacked underneath;

wherein the foldable walls include a first wall and a second wall;

wherein the second wall is connected to and partly overlaps the first wall in the erected state;

wherein the second wall includes a first and a second foldable extended wall portion and an intermediate wall portion;

wherein the first and the second extended wall portions are hinged to a first and a second edge of the intermediate wall portion, respectively;

wherein each of the first and the second extended wall portions includes at least one reinforcement element; and wherein the first wall includes at least one reinforcement element which is shaped to fit and arranged within the reinforcement element of the first and the second extended wall portions, respectively, in the erected state.

2. The collapsible box according to claim 1, wherein the guiding element is a groove arranged along the side edges of an outer surface of the bottom.

3. The collapsible box according to claim 2, wherein the groove is configured to receive the upper rim of another collapsible box stacked underneath.

4. The collapsible box according to claim 1, wherein the box substrate is of an integral, one-piece construction.

5. The collapsible box according to claim 1, wherein the box is stackable in the collapsed state in which the box substrate is substantially planar.

6. The collapsible box according to claim 1, wherein each of the walls, in the erected state, forms an angle of less than 90° to the bottom.

7. The collapsible box according to claim 1, wherein at least a part of a top edge of the second wall at least partly overlapping the first wall slightly protrudes above the first wall in a direction away from the bottom.

8. The collapsible box according to claim 1, wherein the first and the second extended wall portions are arranged to at least partly engage an inner surface of the first wall, respectively, in the erected state.

9. The collapsible box according to claim 1, wherein the at least one reinforcement element of the extended wall portions and the at least one reinforcement element of the first wall is shaped as a wedge.

10. The collapsible box according to claim 1, wherein at least a part of a top edge of the first and the second extended wall portions protrude above the first wall in a direction away from the bottom, in the erected state.

11. The collapsible box according to claim 1, wherein the first and the second extended wall portions include at least one protruding part that engages at least one recess provided in the bottom, in the erected state.

12. The collapsible box according to claim 1, wherein the first and the second extended wall portions are connected to the first wall, respectively, by the lock mechanism; and wherein the lock mechanism is a snap-lock arrangement.

13. The collapsible box according to claim 1, wherein each of the walls includes a reinforcement element having a base part arranged in a direction away from the bottom.

14. A collapsible box comprising:

a bottom with a plurality of side edges;

a plurality of foldable walls, each of which is hinged to one of the side edges of the bottom, respectively;

wherein each of the walls is foldable between a collapsed state and an erected state, in which the walls are connected by a lock mechanism;

wherein the bottom and the walls in the erected state define a space;

wherein the bottom includes a guiding element configured to receive at least a part of an upper rim of another collapsible box stacked underneath;

wherein the foldable walls include a first wall and a second wall;

wherein the second wall is connected to and partly overlaps the first wall in the erected state;

wherein the second wall includes a first and a second foldable extended wall portion and an intermediate wall portion;

wherein the first and the second extended wall portions are hinged to a first and a second edge of the intermediate wall portion, respectively; and wherein the first and the second extended wall portions include at least one protruding part that engages at least one recess provided in the bottom, in the erected state.

* * * * *